US005310199A

United States Patent [19]

Korkin

[11] Patent Number: 5,310,199

[45] Date of Patent: May 10, 1994

[54] CONVERSION SEAT KIT

[76] Inventor: Jason M. Korkin, 8 Old Bedford Rd., Bedford, N.H. 03110

[21] Appl. No.: 72,079

[22] Filed: Jun. 7, 1993

[51] Int. Cl.[5] ..... A47D 1/10

[52] U.S. Cl. ..... 280/87.01; 297/130

[58] Field of Search ..... 297/130; 248/188.7; 280/87.01, 727

[56] References Cited

U.S. PATENT DOCUMENTS

| | | | |
|---|---|---|---|
| 1,370,176 | 3/1921 | Wollam | 297/130 X |
| 1,952,467 | 3/1934 | Slee | 297/130 X |
| 2,918,243 | 12/1959 | Johnson et al. | 248/188.7 |
| 3,223,431 | 12/1965 | Gottfried et al. | 297/130 X |
| 4,100,952 | 7/1978 | Neudorfer | 248/188.7 X |
| 4,440,331 | 4/1984 | Schmarels | 297/130 X |

FOREIGN PATENT DOCUMENTS

| | | | |
|---|---|---|---|
| 1930891 | 12/1970 | Fed. Rep. of Germany | 297/130 |

*Primary Examiner*—Peter R. Brown

*Attorney, Agent, or Firm*—Leon Gilden

[57] ABSTRACT

A seat member including a vertical seat back mounted to a horizontal seat bottom includes a mounting member mounting the seat to a floor plate of a transport vehicle, such as a sled or wagon, wherein the vertical seat back and the horizontal seat bottom each include loop pairs selectively securable to channeling tether lines for permitting suspension of the seat to an overhead support for use of the seat as a swing structure. The seat utilizes a "Y" shaped belt harness for securement of an individual to the seat structure.

1 Claim, 4 Drawing Sheets

CONVERSION SEAT KIT

BACKGROUND OF THE INVENTION

1. Field of the Invention

The field of invention relates to seat apparatus, and more particularly pertains to a new and improved conversion seat kit wherein the same is arranged for selective mounting to a transport vehicle or alternatively to an overhead support.

2. Description of the Prior Art

Seat structure of various types are utilized throughout the prior art in the mounting of an individual to various modes of entertainment and transport. Particularly in association of small children mounted to the seat structure and particularly children with limited physical capacity, the seat organization of the prior art has failed to provide an organization to permit security and convenience in the mounting of the seat structure relative to a transport vehicle and alternatively to an overhead support for the use of the seat as a swing.

As such, it may be appreciated that there continues to be a need for a new and improved conversion seat kit as set forth by the instant invention which address both the problems of ease of use as well as effectiveness in construction and in this respect, the present invention substantially fulfills this need.

SUMMARY OF THE INVENTION

In view of the foregoing disadvantages inherent in the known types of seat apparatus now present in the prior art, the present invention provides a conversion seat kit wherein the same is arranged for selectively mounting to a transport vehicle floor plate, or alternatively may be utilized as a swing structure. As such, the general purpose of the present invention, which will be described subsequently in greater detail, is to provide a new and improved conversion seat kit which has all the advantages of the prior art seat apparatus and none of the disadvantages.

To attain this, the present invention provides a seat member including a vertical seat back mounted to a horizontal seat bottom, including a mounting member mounting the seat to a floor plate of a transport vehicle, such as a sled or wagon, wherein the vertical seat back and the horizontal seat bottom each include loop pairs selectively securable to channeling tether lines for permitting suspension of the seat to an overhead support for use of the seat as a swing structure. The seat utilizes a "Y" shaped belt harness for securement of an individual to the seat structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved conversion seat kit which has all the advantages of the prior art seat apparatus and none of the disadvantages.

It is another object of the present invention to provide a new and improved conversion seat kit which may be easily and efficiently manufactured and marketed.

It is a further object of the present invention to provide a new and improved conversion seat kit which is of a durable and reliable construction.

An even further object of the present invention is to provide a new and improved conversion seat kit which is susceptible of a low cost of manufacture with regard to both materials and labor, and which accordingly is then susceptible of low prices of sale to the consuming public, thereby making such conversion seat kits economically available to the buying public.

Still yet another object of the present invention is to provide a new and improved conversion seat kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
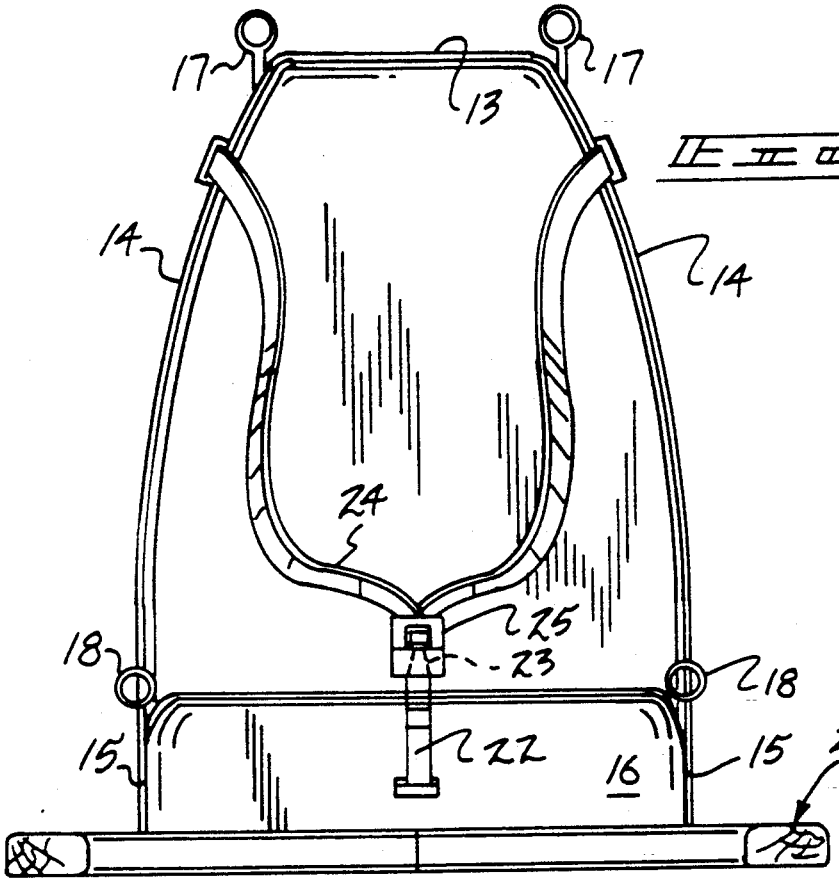
FIG. 1 is an orthographic front view of the seat member utilized by the invention.
Figure 2:
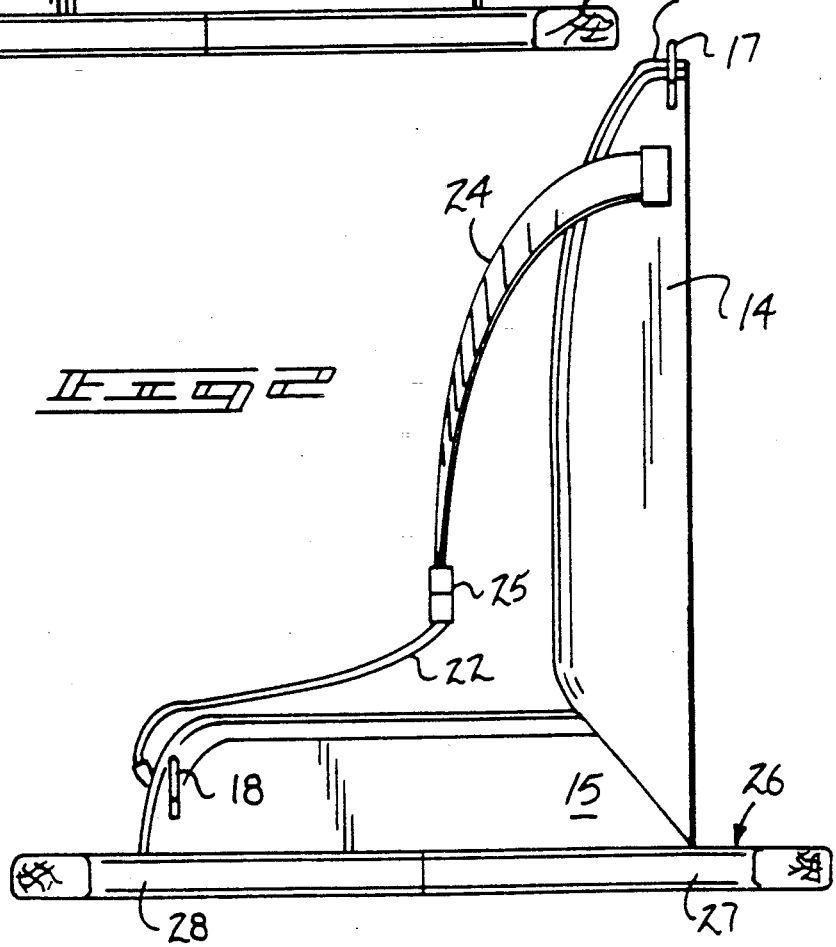
FIG. 2 is an orthographic side view of the seat member utilized by the invention.
Figure 3:
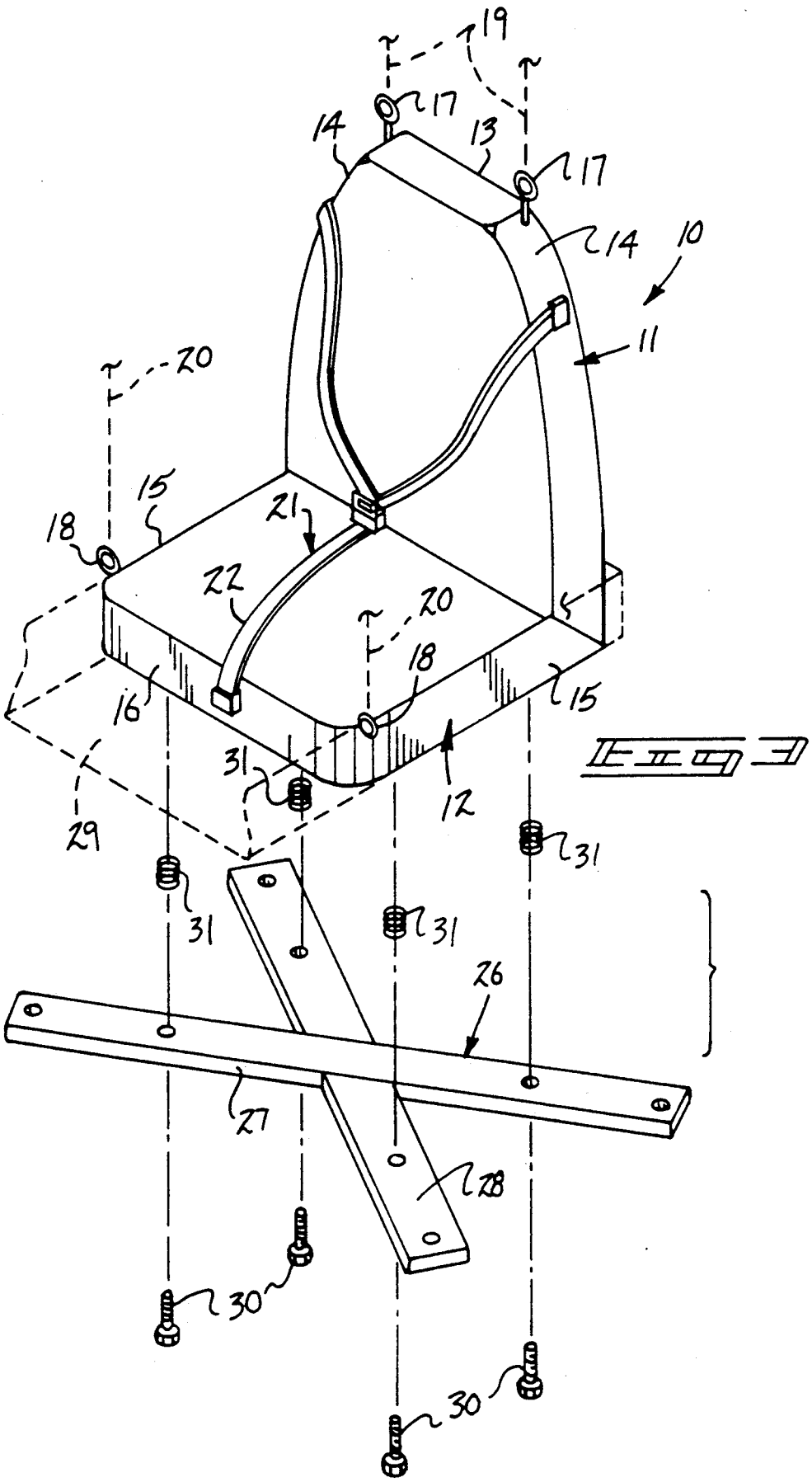
FIG. 3 is an isometric illustration of the apparatus in association with a mounting member for selective use as a swing or as a seat within a transport vehicle.

With reference now to the drawings, and in particular to FIGS. 1 to 6 thereof, a new and improved conversion seat kit embodying the principles and concepts of the present invention and generally designated by the reference numeral 10 will be described.

Figure 4:
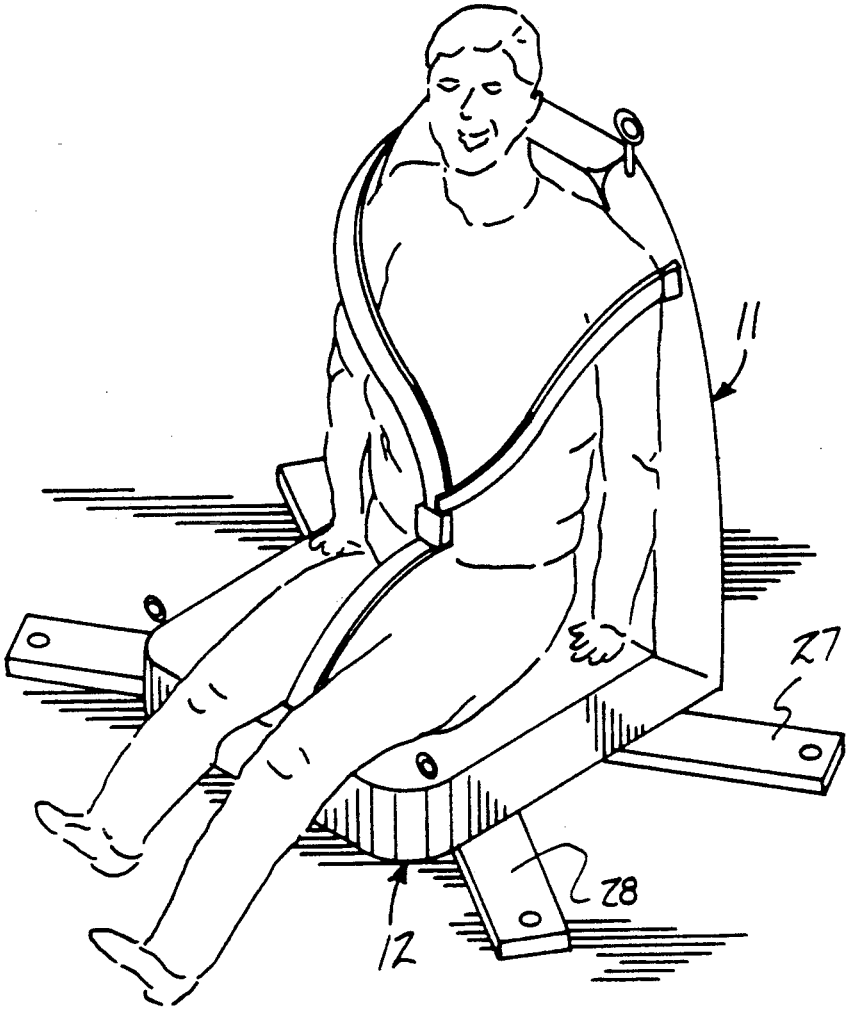
FIG. 4 is an isometric illustration of the invention illustrating in an individual mounted within the seat member.
Figure 5:
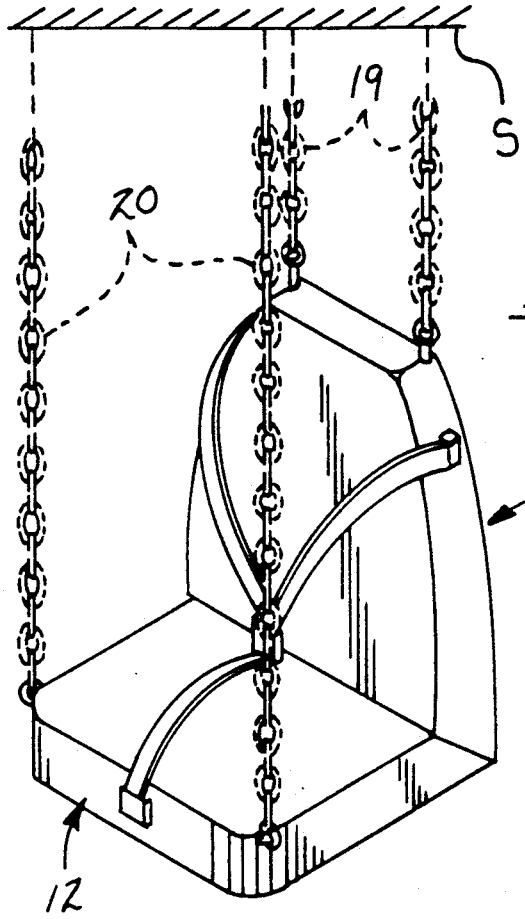
FIG. 5 is an isometric illustration indicating the organization for use as a swing.
Figure 6:
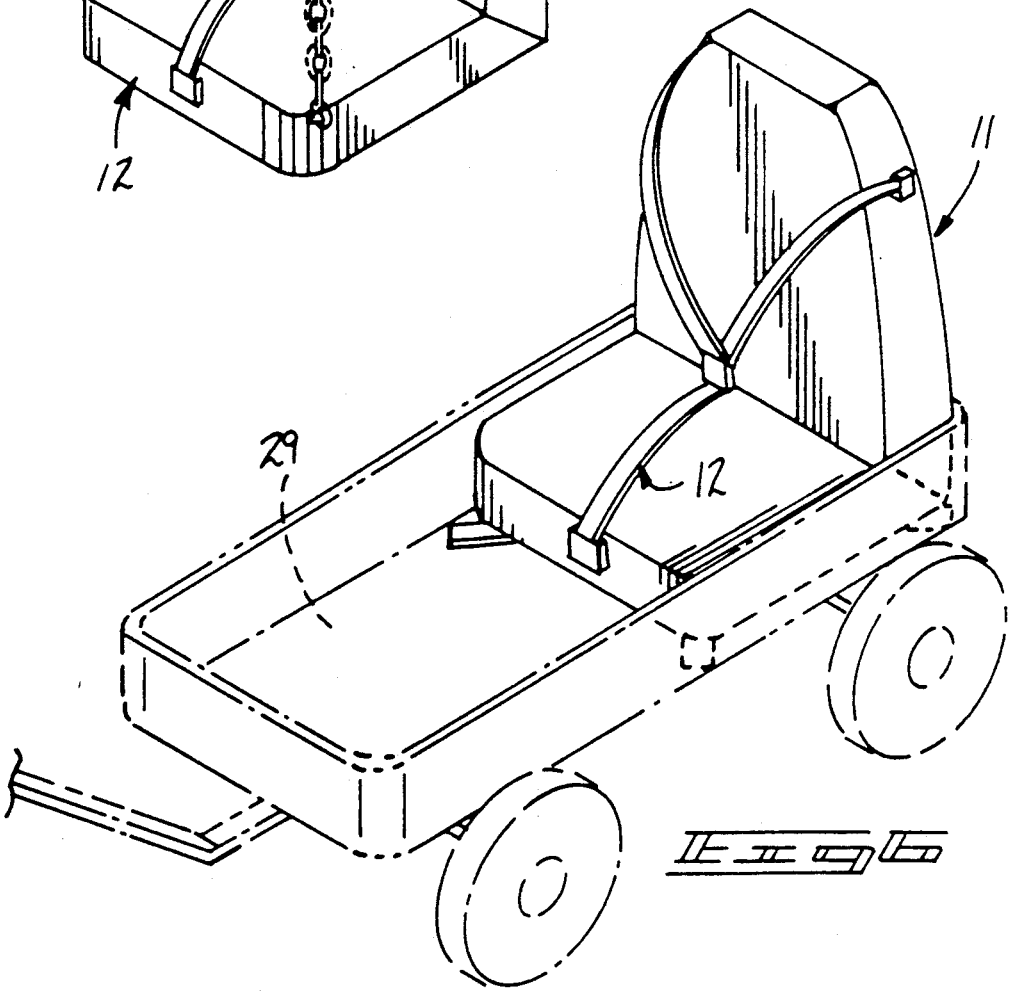
FIG. 6 is an isometric illustration of the invention for use as a seat within a transport vehicle.

More specifically, the conversion seat kit 10 of the instant invention essentially comprises a seat member, including a vertical seat back 11 mounted to a horizontal seat bottom 12. The seat back 11 includes a top wall 13 defined by a first width, with seat back side walls 14 converging upwardly from the seat bottom 12 defined by a second width greater than the first width to provide for converging side walls 14. The seat bottom includes seat bottom side walls 15 and a seat bottom front wall 16. A plurality of first support loops 17 are fixedly mounted to the seat back 11 at an intersection defined between the seat back top wall 13 and the seat back side walls 14. Second support loops 18 arranged parallel to themselves and to the first support loops 17 are mounted at a second intersection defined between the seat bottom side walls 15 and the seat bottom front wall 16. Each support loop of the first and second support loops 17 and 18 mounts tether chains thereto, as illustrated in the FIGS. 3 and 5 for example, to include first tether chains 19, with a single chain mounted to each of the first support loops 17 and second tether chains 20, with a single second chain 20 mounted to each of the second support loops 18 for suspension from an overlying support "S", as illustrated in FIG. 5. In this manner, the seat member utilizes a spring, as illustrated in FIG. 5, wherein alternatively the kit structure permits use of the seat member for mounting to a transport vehicle floor plate 29 of an associated transport vehicle, as illustrated in FIG. 6, to include front and rear wheel pairs for rotatably mounting the floor plate 29. The front axle is secured to a guide bar to permit guidance of the organization. The seat member includes a "Y" shaped seat belt 21 that includes a first belt member 22 mounted to the seat bottom front wall 16 extending upwardly therefrom terminating in a clasp 23. The "Y" shaped seat belt 21 further includes a second "U" shaped belt member 24 whose ends are each mounted to a respective side wall 14 of the seat back. The "U" shaped belt member 24 includes a buckle 25 mounted medially of the belt member 24 for selective latching of the clasp 23 therewithin for securement of an individual to the seat member, as illustrated in FIG. 4.

In mounting of the seat member to the transport vehicle, a mounting member 26 is provided that is mounted to a bottom surface of the transport vehicle floor plate, with the seat member mounted to a top surface of the transport vehicle floor plate. The mounting member 26 includes a first mounting bar 27 medially intersecting a second mounting bar 28. Adjacent each distal end of the first and second mounting bars, fasteners 30 are directed therethrough to secure the mounting member 26 to the bottom surface of the transport vehicle floor plate, with the fasteners directed through the floor plate 29 and received within a bottom surface of the horizontal seat bottom.

It should be noted that the mounting bar is of a generally "X" shaped configuration to prevent undesirable rocking of the seat member relative to the transport vehicle floor plate 29 when in a mounted association therewith. Further, it should be noted that additional fasteners 31 may be utilized directed through the respective first and second mounting bars 27 and 28 to enhance securement into the seat member seat bottom 12 to enhance stability of the organization in an assembled configuration.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A conversion seat kit for selective use as a mounting support within a transport vehicle, wherein the kit includes a seat member, the seat member including a vertical seat back mounted to a horizontal seat bottom, the seat back includes a seat back top wall defined by a first width and the seat bottom is defined by a second width, wherein the second width is greater than the first width, wherein the seat back includes seat back side walls converging from the seat bottom to the seat back top wall, and the seat bottom including seat bottom side walls in fixed cooperation with the seat bottom extending forwardly of the seat back side walls and the seat bottom including a seat bottom front wall, and first support loops fixedly mounted to the seat back adjacent a first intersection defined between convergence of the seat back side walls, and the seat back top wall, and second support loops secured to the seat bottom adjacent second intersection defined by convergence of the seat bottom side walls with the seat bottom front wall, and a transport vehicle, wherein the transport vehicle includes a transport vehicle floor plate, the seat member including a mounting member, wherein the mounting member is mounted to a top surface of the transport vehicle floor plate, and fastener means directed through the mounting member and through the transport vehicle floor plate for securement within the seat bottom for selective securement of the seat member to the transport vehicle, and the mounting member includes a first rigid mounting bar medially intersecting a rigid second mounting bar, and each respective first and second mounting bar includes respective first and second distal ends, and the fastener means includes a plurality of fasteners with each of said fasteners directed through the mounting bar between the first and second distal ends for fixed securement of the mounting bar to the transport vehicle floor plate, and further fasteners directed through the first and second mounting bar into the seat bottom for securement of the seat bottom to the mounting bar.

* * * * *